US008962123B2

(12) United States Patent
Citterio et al.

(10) Patent No.: US 8,962,123 B2
(45) Date of Patent: Feb. 24, 2015

(54) STRUCTURE FOR BALLISTIC PROTECTION

(75) Inventors: Giorgio Citterio, Monza (IT); Filippo Citterio, Monza (IT)

(73) Assignee: F.lli Citterio S.p.A., Monza (MI) (IT)

( * ) Notice: Subject to any disclaimer, the term of this patent is extended or adjusted under 35 U.S.C. 154(b) by 1025 days.

(21) Appl. No.: 12/575,271

(22) Filed: Oct. 7, 2009

(65) Prior Publication Data

US 2011/0008592 A1 Jan. 13, 2011

(30) Foreign Application Priority Data

Jul. 9, 2009 (IT) ..... MI2009A1222

(51) Int. Cl.

| | |
|---|---|
| ***A01K 1/015*** | (2006.01) |
| ***B32B 5/26*** | (2006.01) |
| ***F41H 5/04*** | (2006.01) |

(52) U.S. Cl.

CPC ..... *F41H 5/0428* (2013.01); *F41H 5/0471* (2013.01)

USPC ..... 428/201; 428/221; 442/135; 442/224

(58) Field of Classification Search

CPC ... F41H 5/0414; F41H 5/0492; F41H 5/0435; B32B 2262/0253; B32B 2262/0101; B32B 2262/0269; C04B 2235/80

USPC ..... 2/2.5; 428/105, 106, 107, 113, 119, 428/156, 213, 292.1, 292.4, 292.7, 304.4, 428/920, 921; 442/86, 134, 135, 324, 326

See application file for complete search history.

(56) References Cited

U.S. PATENT DOCUMENTS

| | | | | |
|---|---|---|---|---|
| 3,722,355 | A * | 3/1973 | King | 89/36.02 |
| 4,613,535 | A | 9/1986 | Harpell et al. | |
| 4,836,084 | A | 6/1989 | Vogelesang et al. | |
| 4,989,266 | A | 2/1991 | Borgese et al. | |
| 5,621,914 | A * | 4/1997 | Ramone et al. | 2/463 |
| 6,276,254 | B1 * | 8/2001 | Cordova et al. | 89/36.02 |
| 6,893,704 | B1 | 5/2005 | Van Der Loo | |
| 7,799,710 | B1 | 9/2010 | Tan | |
| 8,297,601 | B2 * | 10/2012 | Vito et al. | 267/140.11 |
| 2004/0161989 | A1 * | 8/2004 | Dennis et al. | 442/135 |

(Continued)

FOREIGN PATENT DOCUMENTS

| | | |
|---|---|---|
| GB | 2258389 | 2/1993 |
| WO | 91/00490 | 1/1991 |

(Continued)

OTHER PUBLICATIONS

Huang, Y.K., Frings, P.H., and Hennes, E., Mechanical Properties of Zylon/Epoxy Composite, 2002, Composites Part B: engineering, vol. 33, pp. 109-115.*

(Continued)

*Primary Examiner* — Peter Y Choi
*Assistant Examiner* — Christine Rea
(74) *Attorney, Agent, or Firm* — Steinfl & Bruno, LLP

(57) ABSTRACT

A structure for ballistic protections is described. The structure includes at least two distinct textile elements which co-operate to stop an incident bullet along a direction, taking advantage of the dissipation of the energy associated to the bullet impact. The first textile element includes fibers capable of dissipating a part of the energy connected to the incident bullet impact owing to a crystalline phase change. The second textile element includes fibers capable of dissipating a part of energy associated to the incident bullet impact by fibrillation.

16 Claims, 1 Drawing Sheet

(56) References Cited

U.S. PATENT DOCUMENTS

| | | | | |
|---|---|---|---|---|
| 2009/0142557 | A1* | 6/2009 | Hardin | 428/198 |
| 2010/0297388 | A1 | 11/2010 | Dagher et al. | |
| 2011/0008592 | A1 | 1/2011 | Citterio et al. | |
| 2011/0048220 | A1* | 3/2011 | Dickson | 89/36.02 |

FOREIGN PATENT DOCUMENTS

| | | | |
|---|---|---|---|
| WO | WO 2004074761 | A1 * | 9/2004 |
| WO | 2005/065029 | | 7/2005 |
| WO | 2007/115057 | | 10/2007 |

OTHER PUBLICATIONS

Definition of Glue and Adhere from Merriam-Webster Dictionary.*
Italian Search Report for Italian Patent Application MI2009A001223 filed on Jul. 9, 2009 in the name of F. LLI Citterio Spa.
Italian Written Opinion for Italian Patent Application MI2009A001223 filed on Jul. 9, 2009 in the name of F. LLI Citterio Spa.
Office Action issued by the USPTO for U.S. Appl. No. 12/575,301 with a mailing date of Apr. 2, 2012.
Office Action issued by the USPTO for U.S. Appl. No. 12/575,301 with a mailing date of Jul. 6, 2012.
Italian Search Report for Italian Patent Application MI2009A001222 filed on Jul. 9, 2009 in the name of Giorgio Citterio, et al.
Italian Written Opinion for Italian Patent Application MI2009A001222 filed on Jul. 9, 2009 in the name of Giorgio Citterio, et al.
PCT International Search Report mailed on May 23, 2012 for PCT/IT2011/000295 filed on Aug. 11, 2011 in the name of F.LLI Citterio et al.
PCT Written Opinion mailed on May 23, 2012 for PCT/IT2011/000295 filed on Aug. 11, 2011 in the name of F.LLI Citterio et al.

* cited by examiner

STRUCTURE FOR BALLISTIC PROTECTION

CROSS REFERENCE TO RELATED APPLICATIONS

The present application claims priority to Italian patent application MI2009A001222 filed on Jul. 9, 2009, which is incorporated herein by reference in its entirety. The present application may also be related to U.S. patent application Ser. No. 12/575,301, entitled "Multilayered Structure for Ballistic Protection", filed on even date herewith, and incorporated herein by reference in its entirety.

FIELD

The present disclosure relates to a structure for ballistic protections, in particular rigid protections.

BACKGROUND

It is known that, in order to provide protection against bullets fired from a gun (with the speed in the range of 400 m/s), elements are commonly used, which are obtained by superimposing soft or flexible textile structures, composed of high resistance fibers. These structures can be impregnated with synthetic matrices to improve their ballistic behavior, that is to increase their capacity to absorb the impact, without altering their softness and flexibility. However, the so obtained ballistic structures are not suitable for stopping the incident bullet, and consequently to provide appropriate protection, in case of bullets fired from a rifle. In such cases, composite rigid structures are used.

Examples of rigid structures for ballistic protection are provided in U.S. Pat. No. 4,836,084, U.S. Pat. No. 4,613,535 and U.S. Pat. No. 6,893,704.

There are available on the market ballistic plates obtained by superimposing and compacting the layers of unidirectional fabrics, including UHMW polythene fibers, as for example, the fibers marketed with trademarks Dyneema® and Spectra®. Such structures would be able to stop bullets of the Nato 7.62 Ball type fired with a speed of 830 m/s, theoretically even with weight of about 16 kg/m$^2$; however, they would not satisfy the requirements imposed by the regulations (in particular, the N.I.J. regulations 0101.03 and 0101.04), because the maximum trauma value allowed is 44 mm. Thus, it is necessary to use such plates in combination with a soft bullet-proof jacket that contributes to trauma reduction or to increase its weight up to about 19 kg/m$^2$; such changes however, not only limit the practicability of the protective element, due to the higher weight, but they also cause the increase of its cost.

SUMMARY

Embodiments of the present disclosure are directed to an element of ballistic protection that allows to reduce trauma values, without jeopardizing the capability to stop bullets fired from either a gun or a rifle, and to reduce costs and times for protective element manufacturing.

This result is obtained by making a structure comprising at least one first and one second textile elements, which are distinct and co-operate with each other to dissipate the energy associated with an incident bullet impact, the structure being characterized in that the first textile element includes fibers capable of dissipating a part of the energy associated to the incident bullet impact by modifying the crystalline phase, and the second textile element includes fibers capable of dissipating a part of energy associated to the incident bullet impact by fibrillation.

Said first textile element can be placed in front of the second one or, in other words, on the side facing the attack with respect to the direction of the incident bullet.

Moreover, the first textile element can include polyethylene fibers, in particular UHMW polyethylene fibers, such as DYNEEMA® or SPECTRA® fibers. Typically, said second textile element is made of aramidic fibers such as KEVLAR®, TWARON® or ARTEC® fibers and mixtures thereof.

The use of a textile element comprising polyethylene or polythene fibers, in particular when combined with a layer comprising aramidic fibers, can increase the structure ballistic performance, in accordance with embodiments of the present disclosure, reducing by more than 25% the trauma value, due to an increase of the bullet impact energy dissipation.

According to an embodiment of the present disclosure, a third element, that constitutes a discontinuity surface between the first and the second textile elements, is interposed therebetween. This third element can be textile or another material, such as for example foams, metals, elastomer or, anyway, compressible materials.

According to another embodiment of the present disclosure, the tensile strength of the fibers of the first textile element can be greater by at least 10% than the tensile strength of the second textile element.

Moreover, the structure can include also a ceramic element situated at the front of said textile elements. This ceramic element can be obtained, for example, with carbide oxides or nitrides (for example alumina, boron carbide, silicon carbide, boron nitride and silicon nitride) based ceramics.

According to a further embodiment, said first textile element is obtained with yarns having tensile strength higher than or equal to 30 g/den, and said second textile element is obtained with yarns having tensile strength higher than or equal to 20 g/den.

In accordance with invention further embodiment, the fibers of the second textile element can be also impregnated, at least partly, in a matrix based on viscous or viscoelastic polymers, which remain liquid up to very low temperatures.

These materials have a glass transition temperature in the range between −40° C. and −128° C.

According to another embodiment, the fibers of said first textile element can be either parallel to the fibers of the second one, or oriented at an angle comprised between 0° and 90° (e.g. 45°) with respect thereto.

Said first textile element can also be impregnated with thermoplastic, thermosetting or elastomeric polymers and combinations thereof and positioned adjacent to the second textile element, even if not in direct contact therewith.

Combination of the textile layers obtained with yarns having different mechanical characteristics, in particular different tensile strength, gives particularly advantageous results.

BRIEF DESCRIPTION OF THE DRAWINGS

Further features of the present disclosure will be better understood by those skilled in the art from the following description and from the enclosed drawings, with reference to non-limiting typical embodiments described by way of illustrative examples, and therefore not to be considered limiting, in which.

DESCRIPTION OF EXAMPLE EMBODIMENTS

Reduced to its essential form and with reference to the figures of the enclosed drawings, a ballistic protection according to an embodiment of the present disclosure includes a structure (S) with two or more textile elements (1, 2), distinct from each other, in which the tensile strength of the yarn of a first textile element (1) is higher by at least 10% than the tensile strength of a second textile element (2). The two textile elements 1 and 2 according to the present embodiment are in direct contact with each other, and can be joined by means of, for example, adhesive substances (e.g. thermosetting, thermoplastic or elastomeric polymers).

Figure 1:
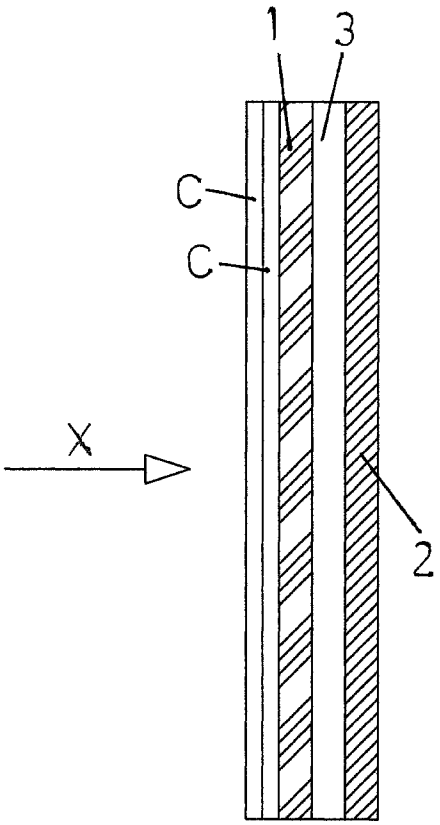
FIG. 1 is a schematic, vertical section view of a structure for making ballistic protections according to a possible embodiment of the present invention.

In the schematic view of FIG. 1, said first textile element (1) is situated before the second one (2), with respect to the direction (X) of the incident bullet.

One or more ceramic elements (C) can be associated to the above described structure.

The structure (S) may lack the ceramic elements (C), if it is aimed at making elements that provide protection from not armor-piercing bullets. The use of the ceramic elements (C) is useful when the structure (S) is intended for making elements aimed at providing protection from bullets fired from a rifle, in particular bullets of penetrating type (7.62×51AP), for example with core of steel having minimum hardness HRC64 or of tungsten carbide.

Figure 2:
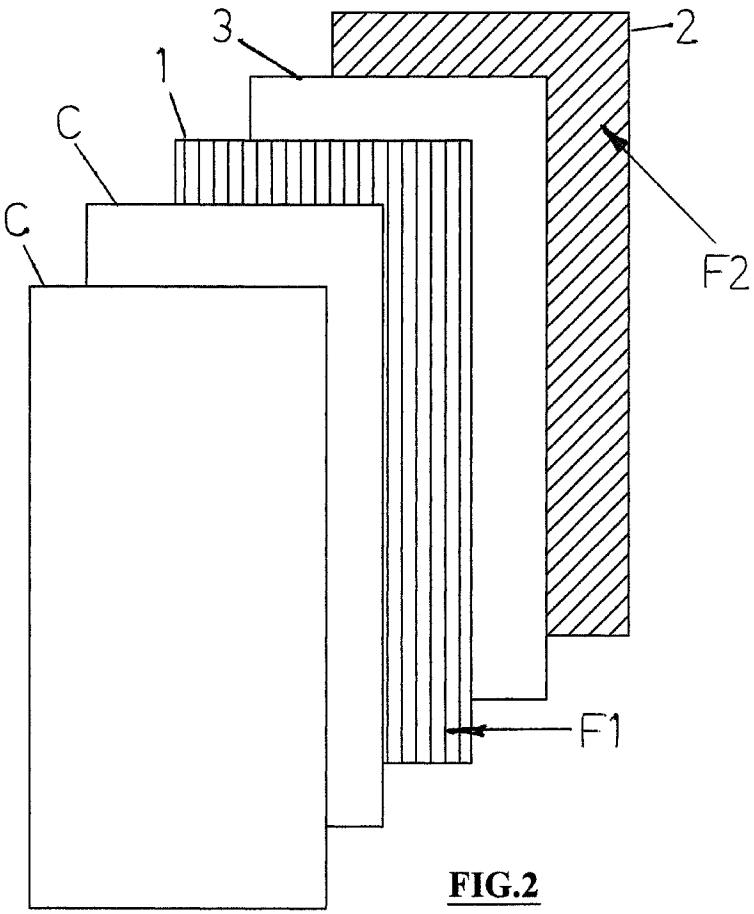
FIG. 2 is a schematic exploded view of the structure of FIG. 1.

Said ceramic elements (C), which can be obtained, for example, from carbide oxides or nitrides based ceramics, can be monolithic or made of juxtaposed ceramic sub-elements, as schematically shown in FIG. 1 and FIG. 2.

Such ceramic elements can also have non coplanar surface for better energy dissipation.

Said first textile element (1) can be obtained with yarns having tensile strength higher than or equal to 30 g/den.

Said second textile element (2) can be obtained with yarns having tensile strength higher than or equal to 20 g/den.

In addition, said first textile element (1) can be obtained with UHMW polythene fibers such as DYNEEMA® or Spectra® fibers that can be impregnated with KRATON® elastomers.

The polyethylene from which the fibers of said first textile element (1) are obtained can be chosen from the group comprising UHMW polyethylene, HDPE polyethylene and mixtures thereof.

The second textile element (2) can be made of aramidic fibers such as KEVLAR®, TWARON® or ARTEC® fibers and mixtures thereof.

Moreover, as previously mentioned, the fibers of the second element (2) can be impregnated, at least partially, in a viscous or viscoelastic polymers based matrix, liquid up to very low temperatures (e.g., with glass transition temperature between −40° C. and −128° C.).

The fibers of said first textile element (1) can be either parallel to the fibers of the second one (2), or oriented at an angle of 0° to 90° with respect thereto (for example, at 45°, as shown schematically in FIG. 2, wherein the fibers of the first textile element are designated at "F1" and those of the second textile element are designated at "F2").

The first textile element (1) can also be impregnated with thermoplastic, thermosetting or elastomeric polymers and combinations thereof and situated adjacent to the second textile element (2), even if not necessarily in direct contact therewith. The use of thermoplastic or thermosetting resins, possibly mixed among them, allows the element (1) to facilitate the incident bullet stop, due to the formation of a rigid composite material.

According to a further embodiment of the present disclosure, said first element (1) can be formed by superimposing and compacting more layers of unidirectional fabric, made up of fibers having elasticity modulus higher than 60 Gpa.

Said fibers can also present elongation greater than 3%, orientation of the molecular chains (Hermann orientation parameter) greater than 80%, crystallinity greater than 65%, and specific weight in the range from 0.94 to 0.99 kg/m$^3$.

Furthermore, said second element (2) can be formed by superimposing and compacting fabrics or multiaxial textile layers, optionally impregnated, as for example KEVLAR XP® fibers.

The second textile element (2) absorbs energy, during the bullet impact step, both in relation to the plasto-elastic deformation action and by the fibers breaking as well as by fibrillation thereof.

In particular, the combination of two elements (1, 2), the second of which is capable of inducing energy dissipation by fibrillation, provides beneficial ballistic protection.

In the second element (2), the alternate layout of thermoplastic or thermosetting adhesives (that serves to connect the fibrous layers of the adjacent unidirectional fabrics) and fibers impregnated with liquid viscous or viscoelastic polymer allows energy high values dissipation, due to the friction of the resin between the fibers (delamination effect between fibril and resin), thus ensuring structure stability due to the presence of the foregoing adhesive.

The above described structure (S) achieves reduction of the trauma values and a V50 substantially unaltered with respect to the one relative to only one element (1).

Ballistic plates can thus be produced, which are lighter but wholly complying with regulations in force, with reference to the trauma values as well as to the V50.

The "packages" formed by the elements (1) and (2) of the structure (S) can be glued to each other, firmly, weakly or not at all. A discontinuity element (3) can also be interposed between the packages.

Experimental tests have ascertained that, with the same V50, when the elements (1) and (2) are not glued to each other, the trauma value is reduced (−6 mm) with respect to the trauma value related to a structure formed by the same elements (1) and (2) being glued.

Interposing a soft element between the elements (1) and (2), thereby creating a discontinuity between these elements, the trauma value is further reduced (−8 mm) and the V50 increased (+20 m/s).

The discontinuity element (3) can be formed by sheets of foam of different thickness, felts, and, more generally, by elements whose Shore hardness is lower by at least 10% with respect to the hardness measured between the two packages (1, 2), between which the discontinuity element is situated.

According to a further embodiment, the structure (S) is composed of about 85% by weight of element (1) and about 15% by weight of element (2).

According to another embodiment, the structure (S) is composed of about 60% by weight of element (1) and about 40% by weight of element (2).

According to yet another embodiment, the structure (S) is composed of about 60% by weight of element (1) and about 36% by weight of element (2) and about 4% by weight of element (3).

Further combinations are possible, depending on the desired combination of the trauma value and V50.

The structure (S) can be obtained using, for example, presses, autoclave apparatuses and other traditional production systems.

The following examples are related to experimental tests conducted by the Applicant, and are provided for mere illustrative purposes and are not to be intended as limiting. With reference to all the tests illustrated in the following, the produced structure has been applied on a block of plasticine, in conformity with the N.I.J. regulations, and 3 shots have been fired with 7.62×51 bullets of the NATO Ball type, to check the trauma values and V50.

EXAMPLE 1

Prior Art 72 layers of unidirectional fabric composed of DYNEEMA® HB2 fibers have been pressed at the temperature of 122° C. and under the pressure of 280 bar for 20 minutes (package or element 1). The measured trauma values are indicated in the following table.

| Shot no. | Bullet speed (m/s) | Trauma (mm) | Structure weight (Kg/mq) | Medium trauma (mm) |
|---|---|---|---|---|
| 1 | 828 | 44 | 18.2 | 46.3 |
| 2 | 830 | 47 | | |
| 3 | 830 | 48 | | |

EXAMPLE 2

57 layers of unidirectional fabric composed of DYNEEMA® HB2 fibers (package or element 1) have been pressed at the temperature of 122° C. and under the pressure of 280 bar for 20 minutes in combination with 7 layers of multiaxial fabric of 500 g/m$^2$ (package or element 2) coupled with adhesive film on one side. The measured trauma values are indicated in the following table.

| Shot no. | Bullet speed (m/s) | Trauma (mm) | Structure weight (Kg/mq) | Medium trauma |
|---|---|---|---|---|
| 1 | 832 | 40 | 18.1 | 41.6 |
| 2 | 873 | 42 | | |
| 3 | 926 | 43 | | |

EXAMPLE 3

50 layers of unidirectional fabric composed of DYNEEMA® HB2 fibers (package or element 1) have been pressed at the temperature of 122° C. and under the pressure of 280 bar for 20 minutes in combination with 10 layers of multiaxial fabric of 500 g/m$^2$ (package or element 2) coupled with adhesive film on one side. The measured trauma values are indicated in the following table.

| Shot no. | Bullet speed (m/s) | Trauma (mm) | Structure weight (Kg/mq) | Medium trauma |
|---|---|---|---|---|
| 1 | 826 | 39 | 18.1 | 41 |
| 2 | 881 | 41 | | |
| 3 | 931 | 43 | | |

EXAMPLE 4

37 layers of unidirectional fabric composed of DYNEEMA® HB2 fibers (package or element 1) have been pressed at the temperature of 122° C. and under the pressure of 280 bar for 20 minutes in combination with 10 layers of multiaxial fabric of 500 g/m$^2$ (package or element 2) coupled with adhesive film on one side. The measured trauma values are indicated in the following table.

| Shot no. | Bullet speed (m/s) | trauma (mm) | Structure weight (Kg/mq) | Medium trauma |
|---|---|---|---|---|
| 1 | 826 | 36 | 18.2 | 37.6 |
| 2 | 874 | 38 | | |
| 3 | 860 | 39 | | |

EXAMPLE 5

50 layers of unidirectional fabric composed of DYNEEMA® HB2 fibers (package or element 1) have been pressed at the temperature of 122° C. and under the pressure of 280 bar for 15 minutes in combination with 10 layers of multiaxial fabric of 500 g/m$^2$ (package or element 2) coupled with adhesive film on one side and with non-stick siliconated paper between the two packages. The measured trauma values are indicated in the following table.

| Shot no. | Bullet speed (m/s) | trauma (mm) | Structure weight (Kg/mq) | Medium trauma |
|---|---|---|---|---|
| 1 | 833 | 32 | 18.2 | 34.3 |
| 2 | 868 | 36 | | |
| 3 | 931 | 35 | | |

EXAMPLE 6

A sheet of expanded polyethylene of density 35 kg/m$^2$ and thickness 3 mm has been inserted between the packages (1) and (2) of the example 5. The measured trauma values are indicated in the following table.

| Shot no. | Bullet speed (m/s) | trauma (mm) | Structure weight (Kg/mq) | Medium trauma |
|---|---|---|---|---|
| 1 | 831 | 28 | 18.3 | 28.6 |
| 2 | 881 | 29 | | |
| 3 | 921 | 29 | | |

The term "polymer" as used herein applies both to a polymeric material and resins, natural or synthetic, and mixtures thereof. The term "fiber" as used herein applies to elongated bodies, with longitudinal dimension much greater than the transversal one.

In the illustrated examples, reference has been made to two textile elements (1 and 2) and, optionally, a discontinuity element (3) between the two textile elements. However, it is possible to include a plurality of "packages" formed by the two textile elements (1, 2) with or without adding the discontinuity element (3).

In practice, in any case, the realization details can vary in a corresponding way as for single constructive elements described and illustrated, and as for the indicated materials nature without departing from the adopted solution concept and consequently, remaining within the protection scope provided by the present patent.

The invention claimed is:

1. A structure for rigid ballistic protections, comprising a first textile element, a second textile element, co-operating to dissipate energy associated to an incident bullet impact, and a third element placed between said first textile element and said second textile element wherein:

said first textile element includes first fibers capable of dissipating a part of said energy associated to the incident bullet impact by modifying the crystalline phase;

said second textile element includes second fibers capable of dissipating a part of energy associated to the incident bullet impact by fibrillation;

said first textile element and said second textile element are not directly or indirectly adhered to each other;

said third element provides a discontinuity between the first textile element and said second textile element; and said first textile element, second textile element, and third element are each made of different materials, wherein the first fibers include UHMW polyethylene fibers, the second fibers are aramidic fibers and the third element is made of materials selected from the group consisting of: elastomeric based foams, plastomeric polymers, thermosetting silicones or mixtures thereof, felts, honeycomb structures, siliconized paper, and rubber, and wherein the structure comprises 60% to 85% by weight of the first element, 36% to 15% of the second element, and greater than 0% and up to 4% of the third element.

2. The structure according to claim 1, wherein said third element is made of compressible material having hardness lower than hardness of said first textile element and second textile element.

3. The structure according to claim 1, including at least one ceramic element situated outside and before said first textile element and second textile element with respect to the incident bullet direction.

4. The structure according to claim 3, wherein said at least one ceramic element is made of carbide oxides and/or nitrides based ceramics.

5. The structure as claimed in claim 1, wherein said first fibers have tensile strength higher or equal to 30 g/den and said second fibers have tensile strength higher or equal to 20 g/den.

6. The structure as claimed in claim 1, wherein the second fibers are impregnated, at least partially, in a viscous and viscoelastic polymers based matrix, having glass transition temperature lower than −40° C.

7. The structure as claimed in claim 1, wherein said second textile element is composed of plural fabrics or multiaxial textile layers.

8. The structure as claimed in claim 1, wherein said first textile element is impregnated with thermoplastic, thermosetting or elastomeric polymers, or with a combination thereof.

9. The structure as claimed in claim 1, wherein the first fibers have a modulus of elasticity higher than 60 GPa.

10. A ballistic protective article, including the structure according to claim 1.

11. The structure as claimed in claim 1, wherein the first fibers of said first element are oriented at an angle with respect to second fibers of said second element.

12. The structure as claimed in claim 1, wherein the structure has up to 1% by weight of the third element.

13. A structure for rigid ballistic protections, comprising: a first textile element, a second textile element, and a third discontinuity element, said first, second and third elements co-operating to dissipate energy associated to an incident bullet impact, wherein:

said first textile element includes first fibers capable of dissipating a part of said energy associated to the incident bullet impact by modifying the crystalline phase;

said second textile element includes second fibers capable of dissipating a part of energy associated to the incident bullet impact by fibrillation;

and said first textile element, second textile element and third discontinuity element are independent, made of different materials, and separable, wherein the first fibers include UHMW polyethylene fibers, the second fibers are aramidic fibers and the third element is made of materials selected from the group consisting of: elastomeric based foams, plastomeric polymers, thermosetting silicones or mixtures thereof, felts, honeycomb structures, siliconized paper, and rubber, and wherein the structure comprises 60% to 85% by weight of the first element, 36% to 15% of the second element, and greater than 0% and up to 4% of the third element.

14. The structure according to claim 1, wherein said third element is made of compressible material having hardness at least 10% lower than hardness of said first textile element and second textile element.

15. The structure as claimed in claim 13, wherein the structure is 60% by weight of the first element, 36% of the second element, and 4% of the third discontinuity element.

16. The structure according to claim 13, wherein said third element is made of compressible material having hardness at least 10% lower than hardness of said first textile element and second textile element.

* * * * *